US012578169B1

(12) United States Patent
Mason et al.

(10) Patent No.: US 12,578,169 B1
(45) Date of Patent: Mar. 17, 2026

(54) ARCHERY SIGHT MOUNTING ASSEMBLY

(71) Applicant: Veritas 2, LLC, Madison Heights, VA (US)

(72) Inventors: Tristan Mason, Madison Heights, VA (US); Gregory Summers, Amherst, VA (US); Brent Steele, Lynchburg, VA (US)

(73) Assignee: Veritas 2, LLC, Madison Heights, VA (US)

( * ) Notice: Subject to any disclaimer, the term of this patent is extended or adjusted under 35 U.S.C. 154(b) by 0 days.

(21) Appl. No.: 19/174,173

(22) Filed: Apr. 9, 2025

Related U.S. Application Data

(60) Provisional application No. 63/734,252, filed on Dec. 16, 2024, provisional application No. 63/727,851, filed on Dec. 4, 2024, provisional application No. 63/725,999, filed on Nov. 27, 2024, provisional application No. 63/724,089, filed on Nov. 22, 2024.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 3,084,442 A * 4/1963 Jacobson ..... F41G 1/467 33/265
3,284,904 A * 11/1966 Rade ..... F41G 1/467 33/265
3,355,809 A * 12/1967 Guyton ..... F41G 1/467 33/265
3,526,037 A * 9/1970 Crosby ..... F41G 1/467 359/813
3,854,217 A * 12/1974 Killian ..... F41G 1/467 33/265
4,020,560 A * 5/1977 Heck ..... F41G 1/16 33/265
4,136,461 A * 1/1979 Gasser ..... F41G 1/467 33/265
4,142,298 A * 3/1979 Killian ..... F41G 1/467 33/265

(Continued)

*Primary Examiner* — Alexander R Niconovich
(74) *Attorney, Agent, or Firm* — Leading Edge Law Group, PLC

(57) ABSTRACT

An archery sight mounting assembly includes an elevation rail having a longitudinal axis, an elevation carriage mounted on the elevation rail and a windage assembly connected with the elevation carriage. An elevation adjustment knob is connected with the elevation carriage and is operable to displace the carriage relative to the elevation rail. The windage assembly is operable to displace a scope in a direction normal to the longitudinal axis of the elevation rail. The windage assembly is spaced from the inner circumference of the elevation adjustment knob and includes a windage adjustment knob arranged on a side of the elevation carriage opposite the elevation knob. Alternatively, the windage adjustment knob may be arranged on a side of the elevation rail opposite and beyond the elevation adjustment knob relative to the archer. Rail guide and tension assemblies are also provided between the elevation carriage and the elevation rail.

16 Claims, 13 Drawing Sheets

(56) References Cited

U.S. PATENT DOCUMENTS 4,481,717 A * 11/1984 Kowalski ..... F41G 1/467 124/87
4,535,747 A * 8/1985 Kudlacek ..... F41G 1/467 124/87
4,875,290 A * 10/1989 Finch ..... F41G 1/467 42/137
5,072,716 A * 12/1991 Sappington ..... F41G 1/467 124/87
5,174,269 A * 12/1992 Sappington ..... F41G 1/467 124/87
5,285,767 A * 2/1994 Padilla ..... F41B 5/1426 124/80
5,289,814 A * 3/1994 Maisano ..... F41G 1/467 124/87
5,384,966 A * 1/1995 Gibbs ..... F41G 1/467 124/87
5,414,936 A * 5/1995 Sappington ..... F41G 1/467 124/87
5,507,272 A * 4/1996 Scantlen ..... F41G 1/467 124/87
5,524,601 A * 6/1996 Slates ..... F41B 5/1426 124/87
5,657,740 A * 8/1997 Slates ..... F41G 1/467 124/87
5,694,698 A * 12/1997 Slates ..... F41G 1/467 124/87
6,401,347 B1 * 6/2002 Slates ..... F41G 1/467 33/263
6,430,822 B1 * 8/2002 Slates ..... F41G 1/467 124/87
6,446,347 B1 * 9/2002 Springer ..... F41G 1/467 124/87
6,609,306 B2 * 8/2003 Johnson ..... F41G 1/467 124/87
6,701,632 B2 * 3/2004 Henry ..... F41G 1/467 124/87
6,802,129 B1 * 10/2004 Wirth ..... F41G 1/467 124/87
6,925,721 B2 * 8/2005 Dietz ..... F41G 1/467 124/87
7,278,216 B2 * 10/2007 Grace ..... F41G 1/467 33/265
7,484,303 B1 * 2/2009 Henry ..... F41G 1/467 124/87
7,574,811 B2 * 8/2009 Kurtzhals ..... F41G 1/467 124/87
7,594,335 B1 * 9/2009 Schmitz ..... F41G 1/467 33/265
7,610,686 B1 * 11/2009 Summers ..... F41G 1/467 124/87
7,900,365 B1 * 3/2011 Johnson ..... F41G 1/467 33/265
8,640,349 B2 * 2/2014 Wasilewski ..... F41G 1/467 124/87
8,689,454 B2 * 4/2014 Pulkrabek ..... F41G 1/467 124/87
9,097,491 B2 * 8/2015 Summers ..... F41G 1/467
9,869,528 B2 * 1/2018 Pellett ..... F41G 1/467
10,036,612 B2 * 7/2018 Hamm ..... F41G 1/467
11,519,694 B1 * 12/2022 Hamm ..... F41G 1/467
11,698,243 B2 * 7/2023 Mason ..... F41G 1/467 33/265
11,754,370 B2 * 9/2023 Mogle ..... F41G 1/44 124/87
12,085,364 B2 * 9/2024 Mason ..... F41G 1/467
12,359,892 B2 * 7/2025 Boezi, III ..... F41G 1/467
2002/0062569 A1 * 5/2002 Slates ..... F41G 1/467 33/265
2014/0130786 A1 * 5/2014 Hall ..... F41B 5/1403 124/87
2018/0292170 A1 * 10/2018 Gagliano ..... F41G 11/003
2024/0068780 A1 * 2/2024 Eads ..... F41G 1/467
2025/0180330 A1 * 6/2025 Mason ..... F41G 1/467

* cited by examiner

ARCHERY SIGHT MOUNTING ASSEMBLY

This application is based on provisional patent application Nos. 63/724,069 filed Nov. 22, 2024, 63/725,999 filed Nov. 27, 2024, 63/727,851 filed Dec. 4, 2024, and 63/734,252 filed Dec. 16, 2024. The entire content of these applications is incorporated herein by reference.

BACKGROUND OF THE INVENTION

Archery sights are used by hunters and competition archers to increase the accuracy of a shot. The sights may be attached directly to a bow but are more typically mounted on a sight elevation rail which in turn is connected with an extension bar. A bow mount or mounting bracket is used to connect the extension bar with the bow. The extension bar is adjustable relative to the bow mount to properly position the sight aperture closer to or farther away from the archer.

In archery competitions, targets may be arranged at a fixed distance from the archer or at multiple distances. Variable distance competitions require adjusting the position of the sight aperture along the elevation rail depending on the distance to the target. To accommodate the various distances, the elevation rail has an extended length for proper positioning of the sight aperture. The extended length adds weight to the target end of the sight mounting system.

BRIEF DESCRIPTION OF THE PRIOR ART

Archery sight mounting devices that mount on a bow are known in the art. One such device is connected with an extension bar via suitable fasteners. The extension bar is connected with a mounting plate attached to a bow via screws or other suitable fasteners. In use, the extension bar generally extends horizontally and the archery sight apparatus extends vertically, with the sight being adjusted for elevation along the elevation bar. The sight mounting assembly includes an elevation carriage and an archery sight aperture or scope connected with the carriage. The elevation carriage is adjustable by the user to adjust the position of the sight for optimum performance. For this purpose, an elevation adjustment knob is provided to operate an elevation drive assembly and a windage adjustment knob is provided to operate a windage drive assembly. The windage adjustment knob has a smaller diameter and is arranged within the elevation adjustment knob on the same side of the assembly.

While such a device normally operates satisfactorily, the overlapping arrangement of the elevation and windage adjustment knobs is unwieldy and creates an imbalance of the assembly which adversely affects the accuracy of a shot.

SUMMARY OF THE INVENTION

The present invention was developed in order to overcome these and other drawbacks of the prior archery sight mounting devices by providing a more balanced sight mounting assembly including an elevation rail having a longitudinal axis, an elevation carriage slidably mounted on the elevation rail and an elevation adjustment knob operable to displace the elevation carriage along the elevation rail. A windage assembly is connected with the elevation carriage for displacing a scope in a direction normal to the longitudinal axis of the elevation rail. More particularly, the windage assembly is arranged beyond the inner circumference of the elevation adjustment knob.

The windage assembly includes a lead screw connected with the elevation carriage and a windage adjustment knob at one end of the lead screw and operable to rotate the screw to displace the scope relative to the elevation carriage. In one embodiment, the windage adjustment knob is arranged on a side of the elevation rail opposite the elevation adjustment knob. In another embodiment, the elevation adjustment knob is arranged on a near side of the elevation rail relative to an archer and the windage lead screw and adjustment knob are arranged on a far side of the elevation rail beyond the elevation adjustment knob.

According to a further object of the invention, a rail guide assembly is arranged between the elevation rail and the elevation carriage. The rail guide assembly includes a keyway for accurate alignment of the elevation carriage relative to the elevation rail in a first direction and a V-shape configuration for accurate alignment of the elevation carriage relative to the elevation rail in a second direction normal to the first direction. A pair of gibs are arranged on opposite sides of the extension rail adjacent to the elevation rail. A pair of tension clamps are arranged on opposite sides of the extension rail to retain the gibs in position between the elevation carriage and the elevation rail. Tension screws are connected with the tension clamps to adjust the amount of tension applied to the gibs. A pair of springs are arranged between the tension screws and the elevation carriage to bias the tension screws and supply consistent minimum tension to the tension clamps.

It is yet another object of the invention to provide a tension assembly between the elevation carriage and the elevation rail. The tension assembly includes a lock lever to control the degree of tension applied between the elevation carriage and the elevation rail to lock and release the elevation carriage in a selected position relative to the elevation rail. The lock lever activates pressure movement of the tension screw from tight to loose in the direction of a target to eliminate left and right arrow impact error from the locked to unlocked condition. A tension screw is threadably connected with the elevation carriage and rotated by the lock lever to lift the elevation carriage from the elevation rail and tighten gibs arranged between the elevation carriage and the elevation rail. The lock lever is further operable to lock the carriage in the selected position.

The sight mounting assembly further includes a sight tape connected with longitudinally spaced openings along the elevation rail. The tape contains at least one opening at the opposite ends thereof so that the tape can be connected with the elevation rail in a selected position by the archer with fasteners which pass through the openings in the ends of the tape into corresponding openings in the elevation rail. The openings may have various configurations which afford increased adjustability for mounting the tape on the elevation rail.

BRIEF DESCRIPTION OF THE FIGURES

Other objects and advantages of the disclosure will become apparent from a study of the following specification when viewed in the light of the accompanying drawing, in which.

DETAILED DESCRIPTION

FIGS. 1-5 illustrate an archery sight mounting apparatus 2 that mounts on a bow. The apparatus is connected with an extension 4 bar via suitable fasteners. The extension bar is connected with a mounting plate attached to a bow (not shown) via screws or other suitable fasteners. In use, the extension bar generally extends horizontally and the archery sight apparatus extends vertically, with the sight being adjusted for elevation along an elevation rail 6.

Figure 6:
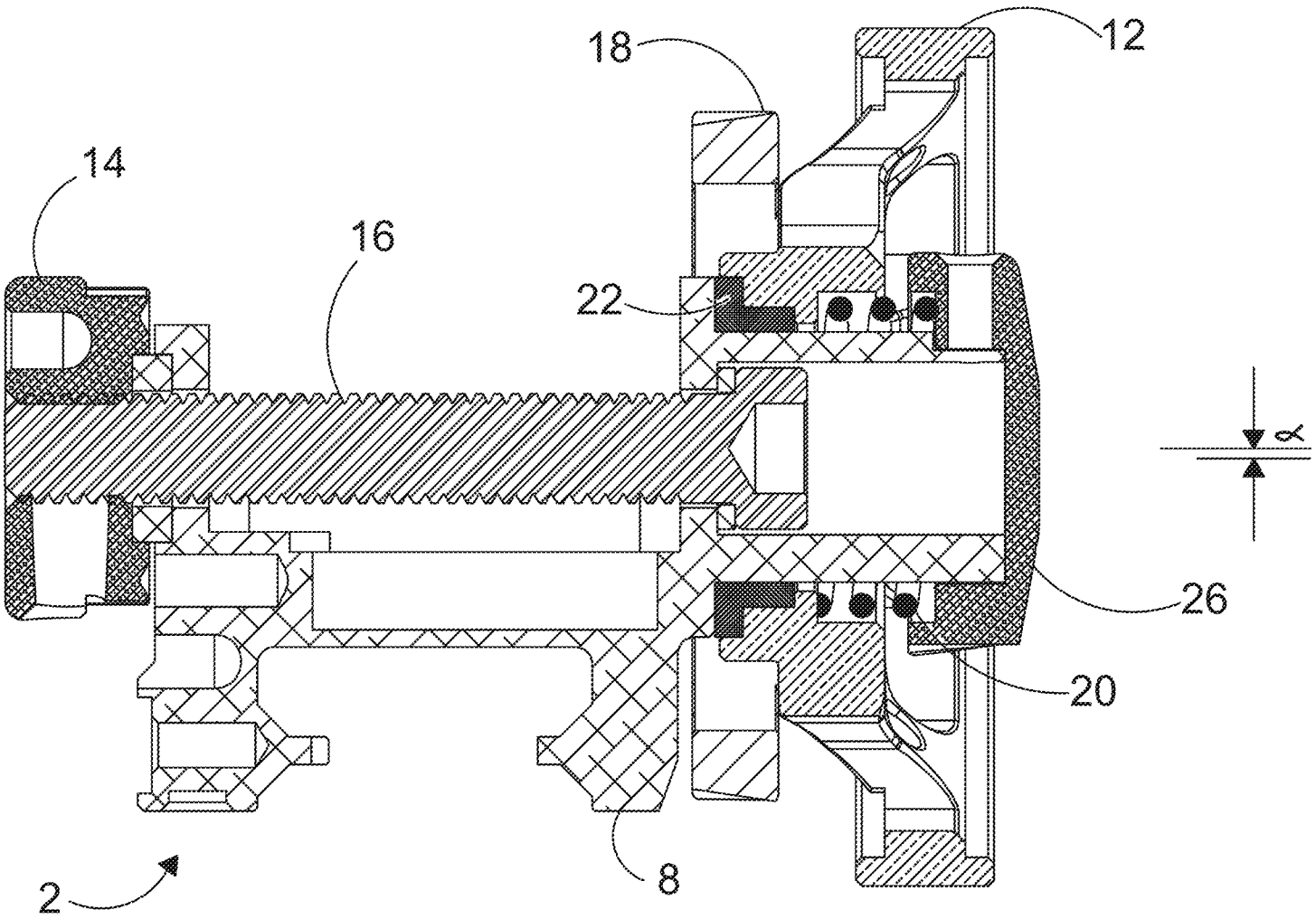
FIG. 6 is a sectional view taken along line 6-6 of FIG. 4.
Figure 7:
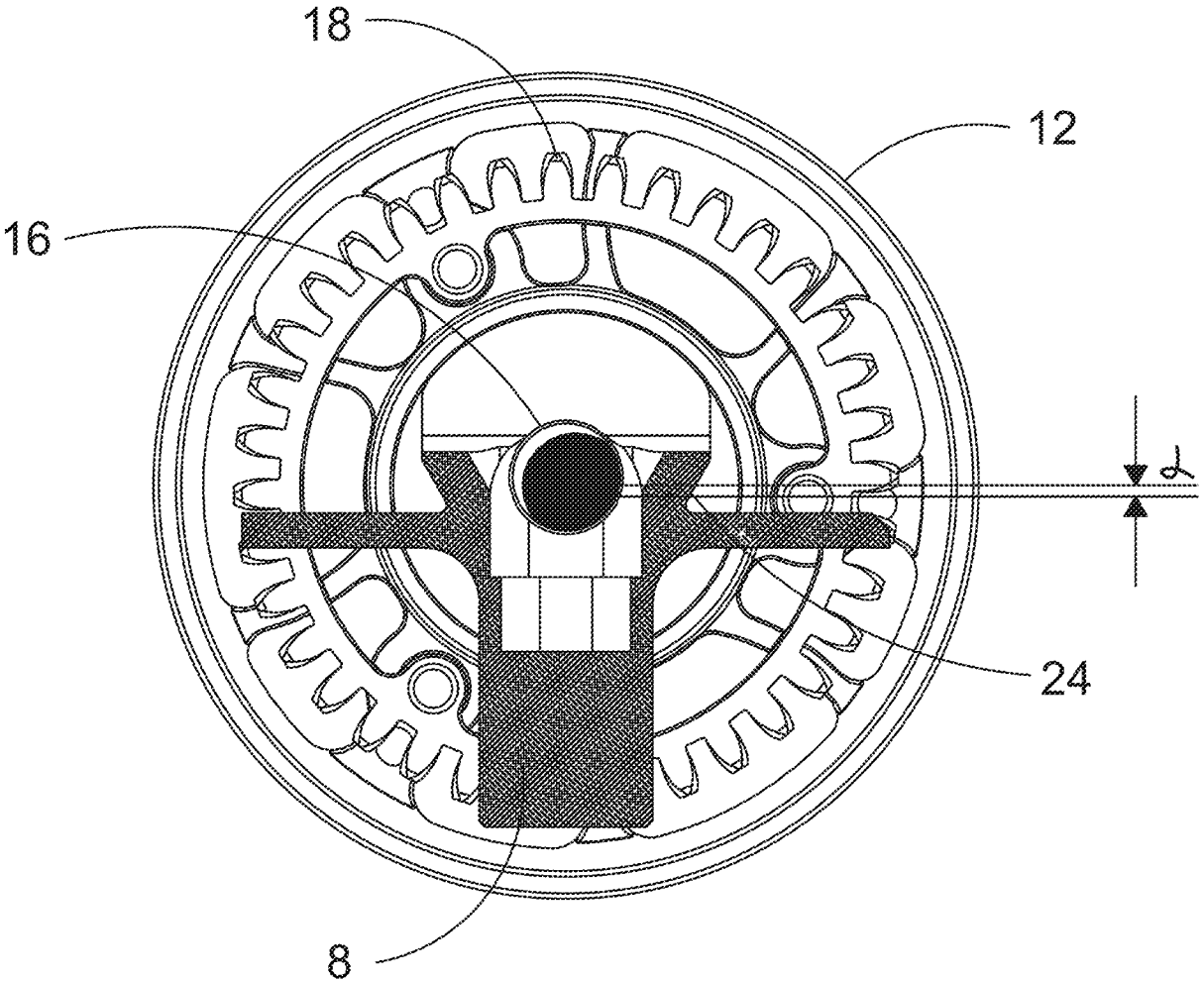
FIG. 7 is a partial sectional view of the elevation carriage, elevation knob and elevation and windage lead screws showing an off-center arrangement of the windage lead screw relative to the center of the elevation knob.

The sight mounting assembly includes an elevation carriage 8 and a scope or aperture 10 connected with the carriage. The elevation carriage is adjustable by the user to adjust the position of the sight for optimum performance. For this purpose, an elevation adjustment knob 12 is provided to operate an elevation drive assembly and a windage adjustment knob 14 is provided to operate a windage drive assembly. As shown in FIG. 6, the windage drive assembly further includes a lead screw 16 rotated by the windage adjustment knob 14. A characterizing feature of the invention is that the windage adjustment knob and lead screw are spaced from the inner circumference of the elevation adjustment knob 12.

The elevation adjustment knob 12 is mounted on the front side of the elevation carriage to move the sight aperture up and down in the vertical axis of the elevation rail 6 connected with the extension bar 4. The smaller windage travel adjustment knob 14 is mounted on the back side of the elevation carriage to move the sight aperture from side to side in the horizontal axis. The windage knob is preferably on the opposite side of the sight from the elevation knob and has a smaller diameter than the diameter of the elevation adjustment knob.

The elevation adjustment assembly includes the elevation adjustment knob 12 as well as a gear 18, spring 20, and bushing 22 which are shown in FIG. 6. According to an alternate embodiment of the invention, the elevation adjustment assembly all spin off center and independent form the windage adjustment knob 14 and lead screw 16. In addition, the dovetail 24 of the windage travel surface is off center from both the elevation and windage adjustment knobs 12, 14 and independent as well. That is, the windage lead screw at the far side of the windage knob and the windage travel surfaces are located off center from the larger elevation knob. The off-center distance a is preferably between 1/64 and 1/4 inches. A spring cap 26 may be provided to cover the interior portion of the elevation adjustment knob. The spring cap, however, does not rotate upon operation of the elevation adjustment knob.

Figure 8:
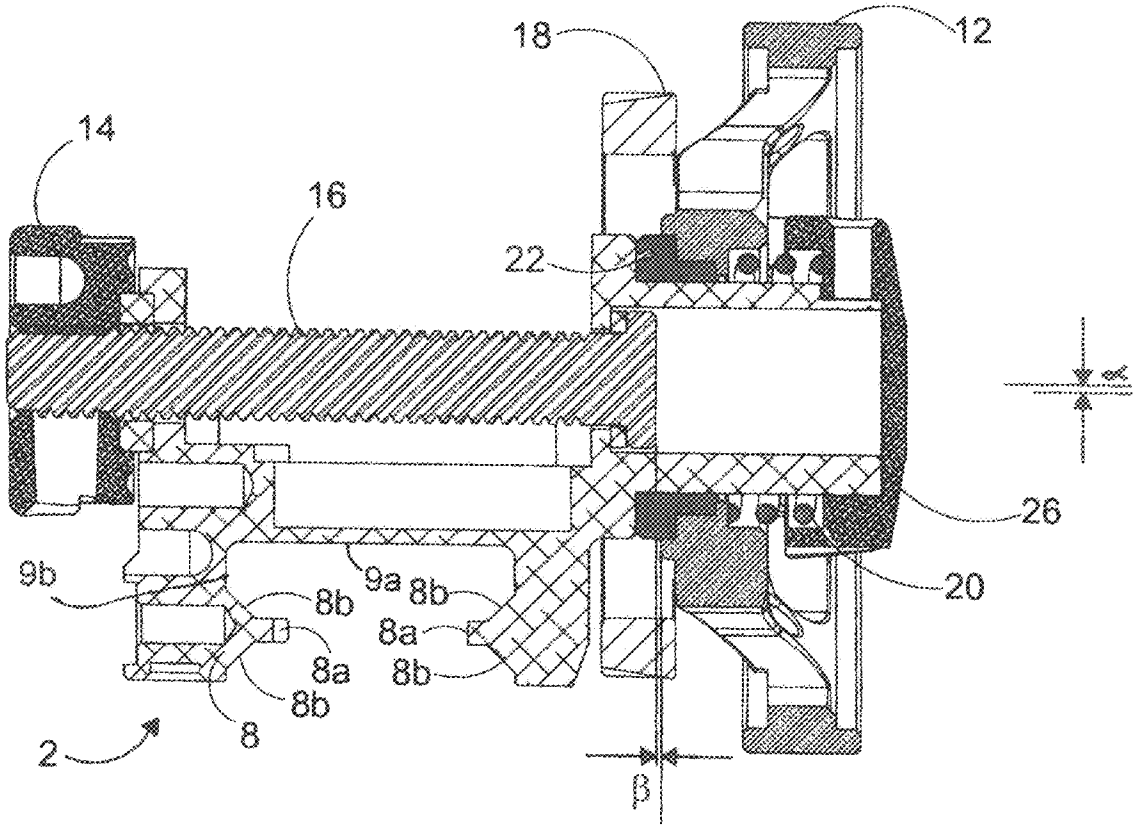
FIG. 8 is a detailed sectional view of the elevation carriage and elevation and windage travel knobs showing an off center-arrangement of the windage lead screw and the axis of the elevation knob.

In addition to, or independently of, the offset arrangement of the axes for the elevation and windage adjustment knobs, the windage drive assembly may be spaced from the inner circumference of the elevation adjustment knob. More particularly, as shown in FIG. 8, the face of the elevation knob 12 which faces the windage drive assembly is spaced from the face of the windage lead screw 16 by a distance B.

Figure 9:
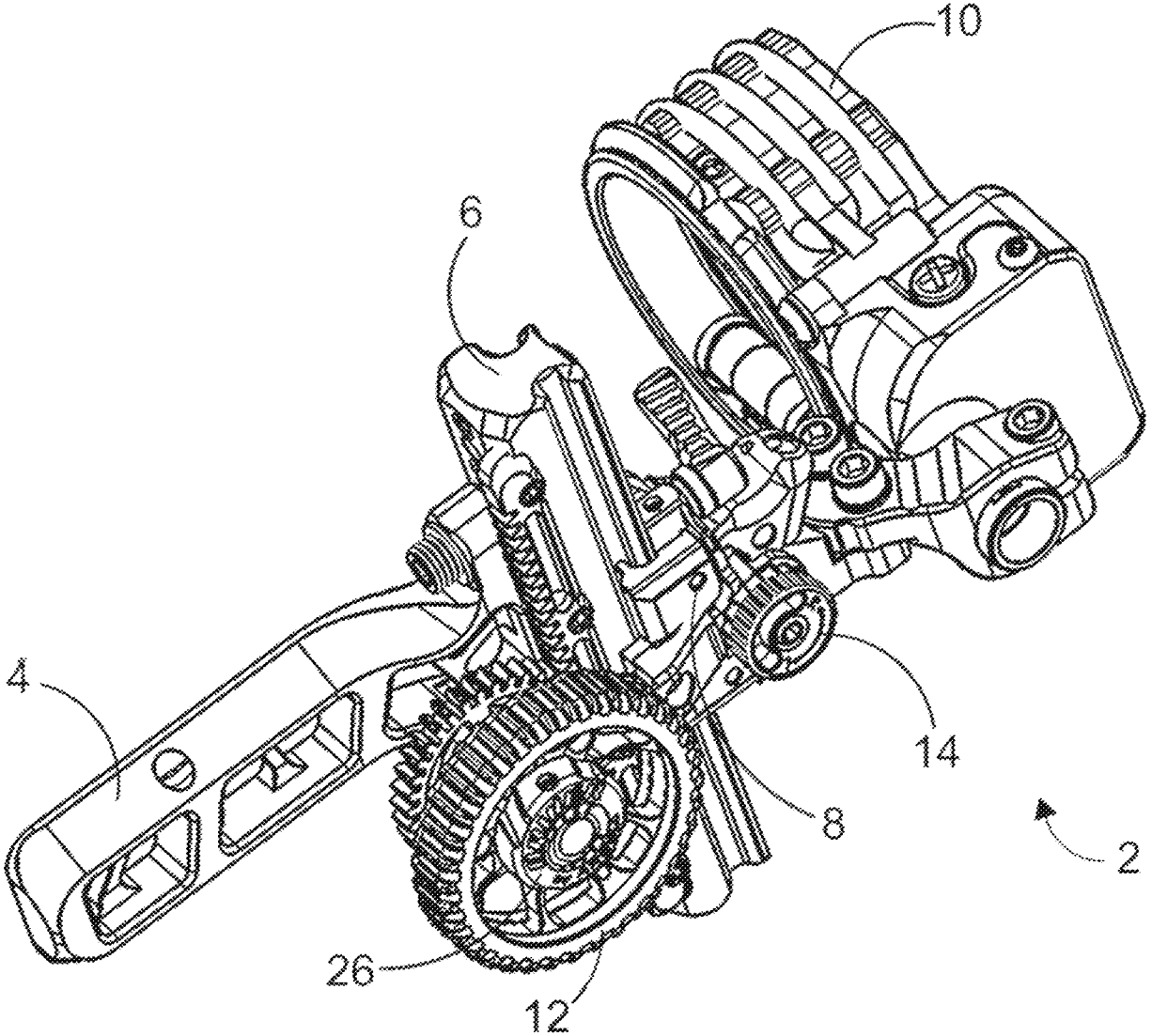
FIGS. 9 and 10 are front and rear perspective views of an alternate embodiment of an archery sight mounting assembly according to the invention.
Figure 10:
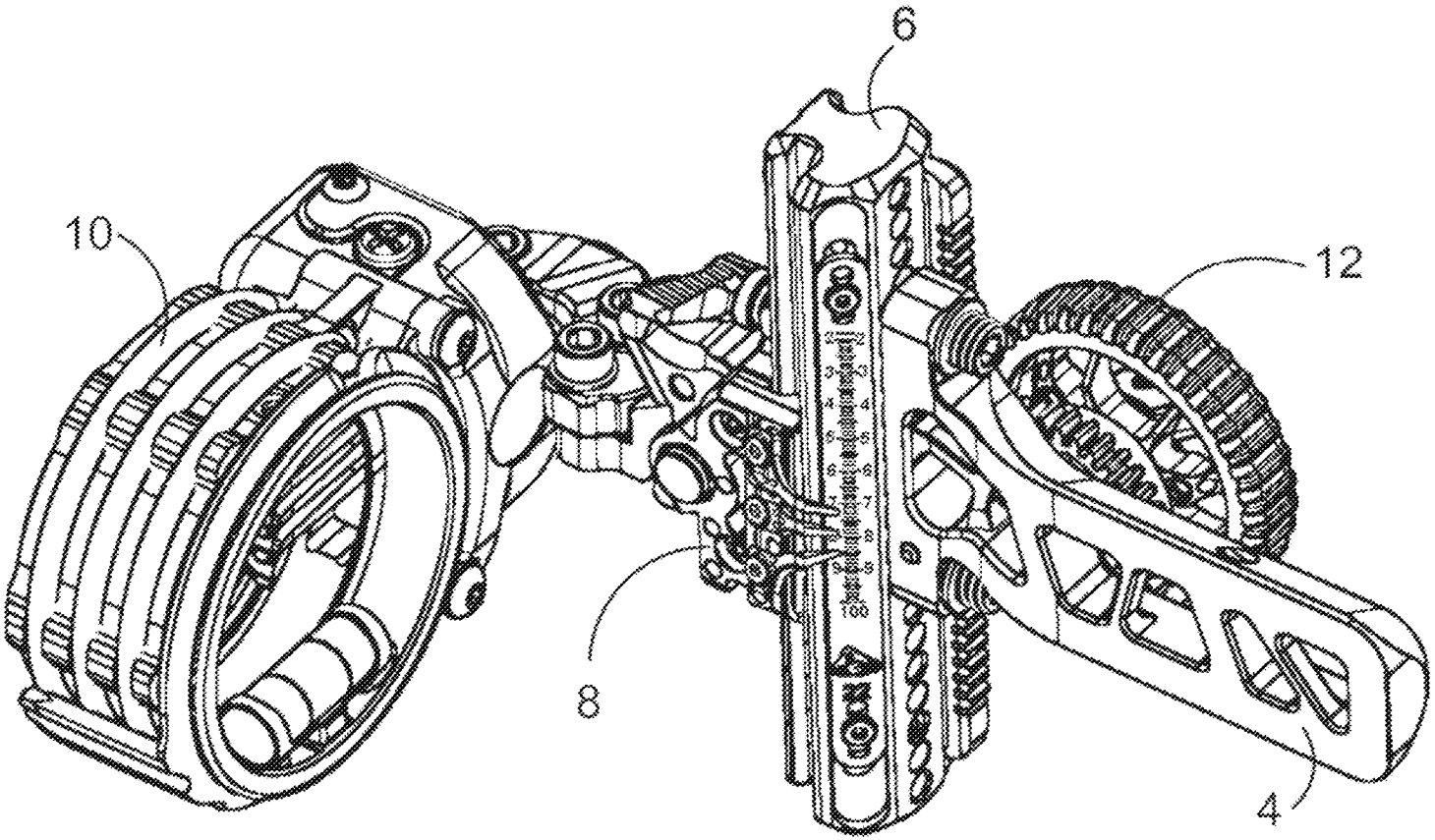

In the embodiments shown in FIGS. 1-8, the elevation and adjustment knobs are located on opposite sides of the elevation carriage. According to a further embodiment of the invention shown in FIGS. 9 and 10, these adjustment knobs may be arranged on the same side of the elevation carriage but on opposite sides of the elevation rail relative to the archer.

Specifically, the elevation adjustment knob 12 is arranged on the front side of the elevation carriage and in front of, i.e. on the near side of, the elevation rail 8. The elevation adjustment knob 12 is operable to move the sight aperture up and down in the vertical axis of the elevation rail 8 connected with the extension bar. The smaller windage adjustment knob 14 is mounted on the rear side of the elevation carriage beyond the elevation rail to move the sight aperture from side to side in the horizontal axis. The windage adjustment knob is thus on the opposite side of the elevation rail from the elevation knob. With the elevation adjustment knob in front of the elevation rail, it is thus closer to the archer. Such an arrangement provides better ergonomics in that the archer does not have to reach out as far to grasp the elevation knob. In addition, the weight of the mounting assembly is more balanced with the weight of the elevation adjustment knob being brought closer to the bow riser.

In an alternate arrangement, the windage adjustment knob can be provided on a side of the elevation carriage opposite the elevation adjustment knob, similar to the arrangement of FIGS. 1-8, but with the elevation adjustment knob one side of the elevation rail and the windage adjustment knob on the other side of the elevation rail. Thus, for a right-handed archer, the elevation adjustment knob would be on the right side of the elevation carriage and the windage adjustment knob would be on the left side of the carriage. Conversely, for a left-handed archer, the elevation adjustment knob would be on the left side of the elevation carriage and the windage adjustment knob would be on the right side of the carriage. In both configurations, the elevation adjustment knob would still be in front of the elevation rail closer to the archer and the windage adjustment knob would be behind the elevation rail further from the archer.

Figure 11:
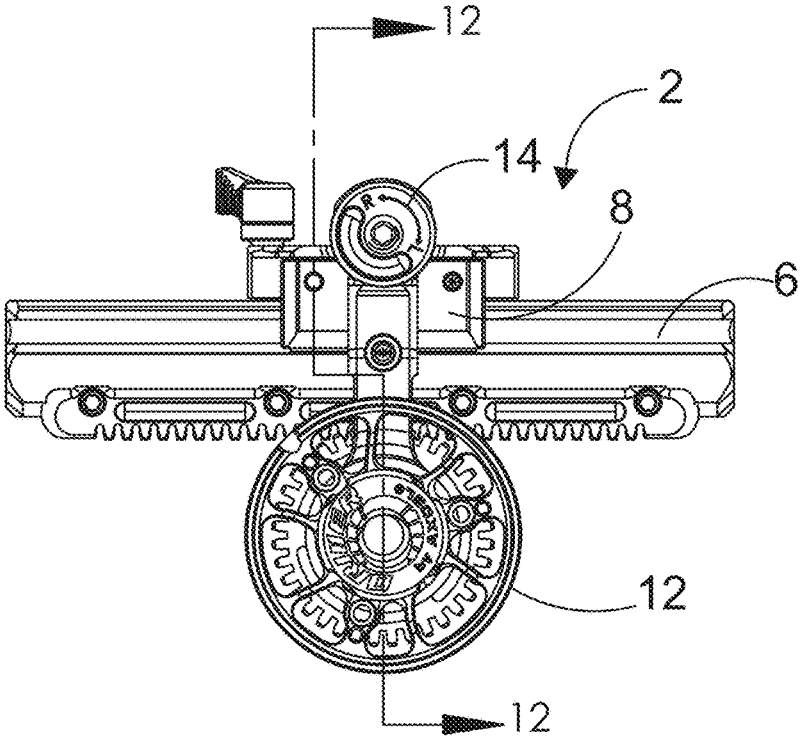
FIG. 11 is a right-side view of the sight mounting assembly and the elevation rail of the assembly of FIGS. 9 and 10.
Figure 12:
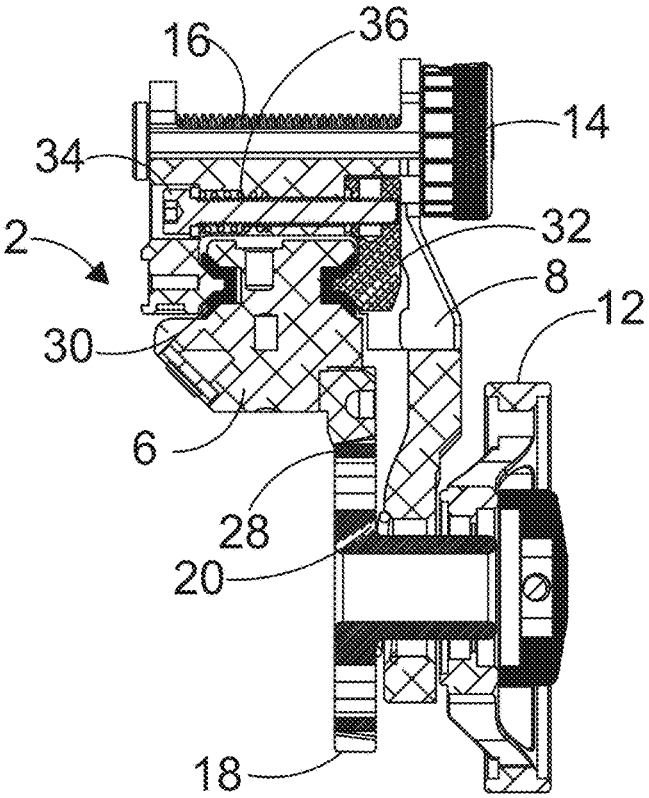
FIG. 12 is a sectional view taken through line 12-12 of FIG. 11.
Figure 13:
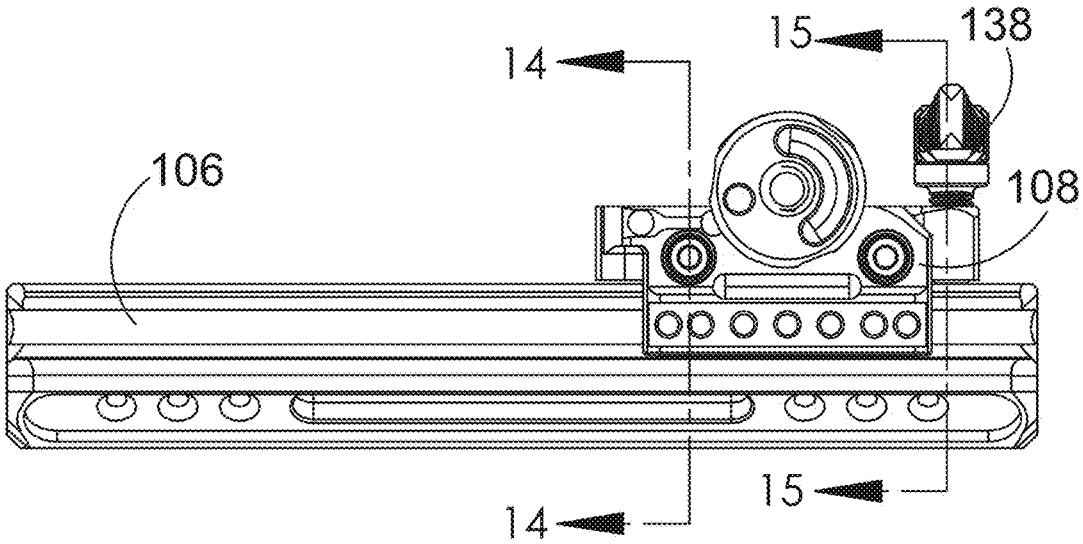
FIG. 13 is a side plan view of the elevation carriage mounted on the elevation rail of the mounting assembly of FIG. 1.

Turning now to FIGS. 8, 11 and 12, a rail guide assembly between the elevation carriage 8 and the elevation rail 6 will be described. As will be developed in greater detail below, the elevation carriage contains a U-shaped channel defined by a planar upper surface 9*a* and opposed side surfaces 9*b* arranged perpendicular to said upper surface for slidably mounting the elevation carriage on the elevation rail. The elevation carriage further includes spaced keyways 8*a* extending toward each other from opposite sides of the carriage for accurate alignment of the elevation carriage relative to the elevation rail in a first direction. The elevation carriage has a V-shape configuration defined by surfaces 8*b* adjacent the keyways 8*a* and the elevation rail has a complementary V-shape configuration corresponding to the configuration of the carriage for accurate alignment of the elevation carriage relative to the elevation rail in a second direction normal to the first direction. In FIG. 11, there is shown the sight mounting assembly on the elevation rail with the drawing being rotated 90° relative to the depiction in FIG. 9 and without the scope or aperture. FIG. 12 is a sectional view of the mounting assembly 2 and rail taken along line A-A of FIG. 11.

As shown in FIG. 12, the elevation adjustment knob is connected with the elevation gear 16 which is arranged on the opposite side of the elevation rail 6 from the elevation carriage 8. The elevation gear engages with an elevation gear rack 28 on the elevation rail 6 so that upon rotation of the elevation adjustment knob and gear, the elevation carriage is displaced along the elevation rail.

The automatic tension gear spring 20 extends between the elevation gear 18 and the drop down attachment when the elevation carriage is located on the rear side of the elevation rail 6. The tension gear spring 20 applies horizontal pressure into the elevation gear rack to ensure that there is no slop in the gear teeth. This in turn applies a downward force or pressure to elevation gibs 30 arranged between the elevation carriage 8 and the elevation rail 6 resulting in the elevation gib slop being pushed in a single consistent direction from shot to shot of arrows by the archer. The end result of this pressure is that it simulates pressuring the scope in a singular direction with equal force to remove all slop and bring the sight aperture back to a respective zero state. An elevation tension clamp 32 is provided which retains the elevation tension gibs against the rail. An elevation tension screw 34 surrounded by a tension spring 36 is provided to adjust the tension applied to the elevation tension clamp.

Figure 14:
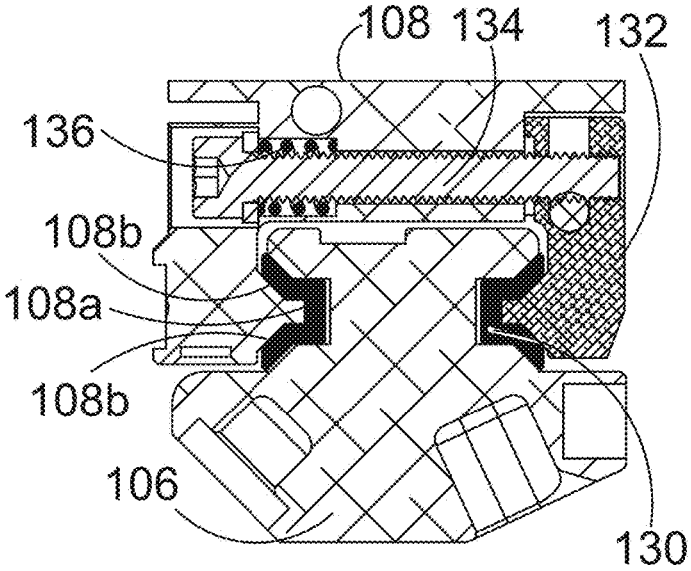
FIG. 14 is a sectional view of the elevation carriage and elevation rail taken along line 14-14 of FIG. 13.
Figure 17:
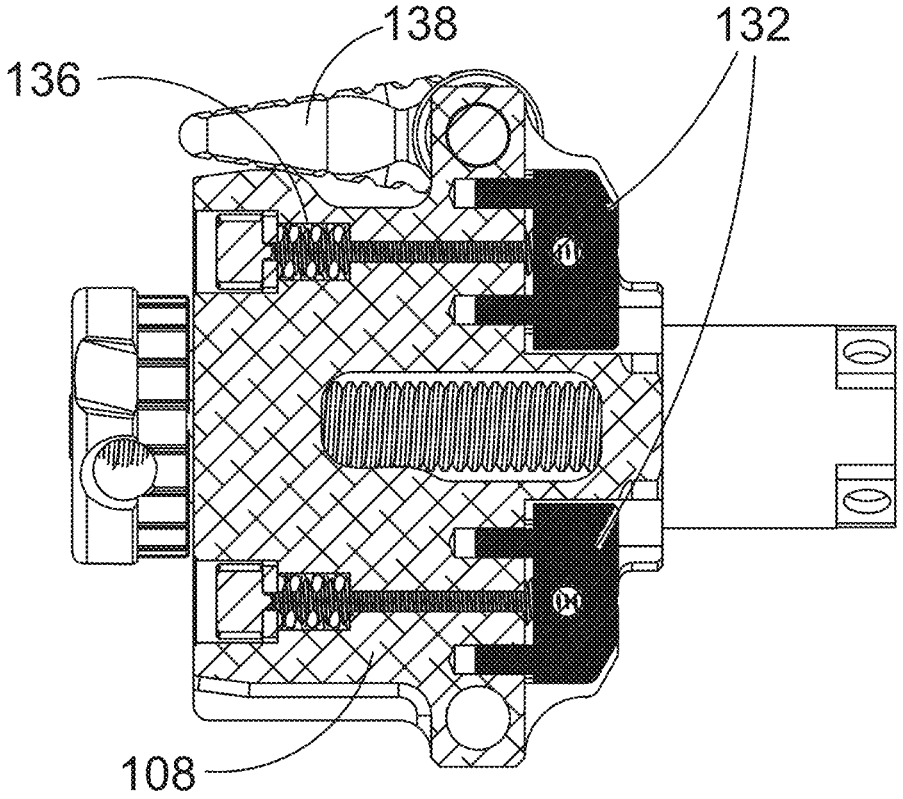
FIG. 17 is a partial sectional view of the elevation tension assembly taken along line 17-17 of FIG. 16.
Figure 18A:
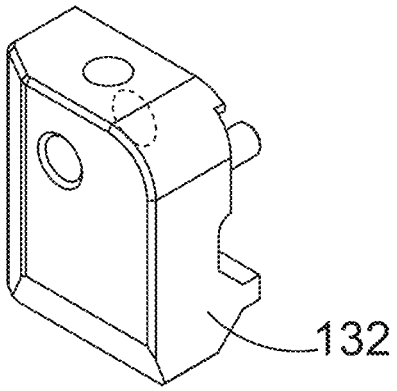
FIGS. 18*a* and 18*b* are front and rear perspective views, respectively, of a tension clamp of the elevation carriage tension assembly of FIG. 17.
Figure 18B:
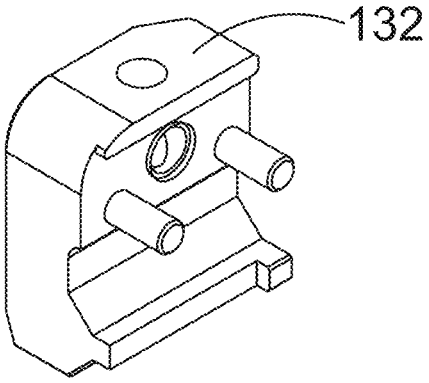

An alternate embodiment of a dual function elevation guide rail and tension assembly arranged between the elevation carriage 108 and the elevation rail 106 will be described with reference to FIGS. 13-18. It also incorporates at least one keyway 108*a* for accurate vertical alignment and a V shape defined by surfaces 108*b* for accurate horizontal alignment. As shown in FIG. 14, plastic gibs 130 are arranged on opposite sides of the rail between the rail and the elevation carriage and are retained by a pair of tension clamps 132 which are adjusted by tension screws or bolts 134. The gibs have a V-shape configuration corresponding to the V-shape configuration of the keyway. A tension clamp is shown in detail in FIGS. 18*a* and 18*b*. As shown in FIGS. 14 and 17, a spring 136 is provided to bias each tension screw to supply automatic consistent minimum tension to the tension clamps when the elevation gib adjustment screws 134 are loose or incorrectly adjusted. The combination of the tension screws, springs, clamps and plastic gibs prevent any vertical or horizontal play or slop in the elevation carriage relative to the elevation rail.

Figure 15:
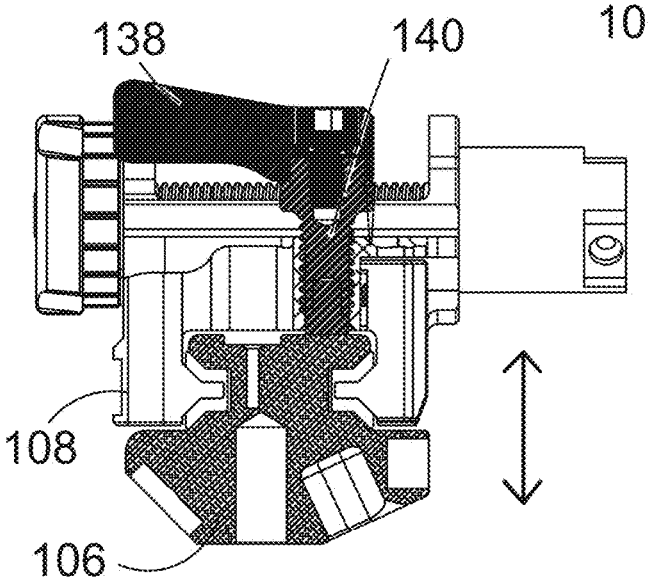
FIG. 15 is a sectional view of the elevation carriage tension assembly of the mounting assembly of FIG. 1 taken along line 15-15 of FIG. 13.
Figure 16:
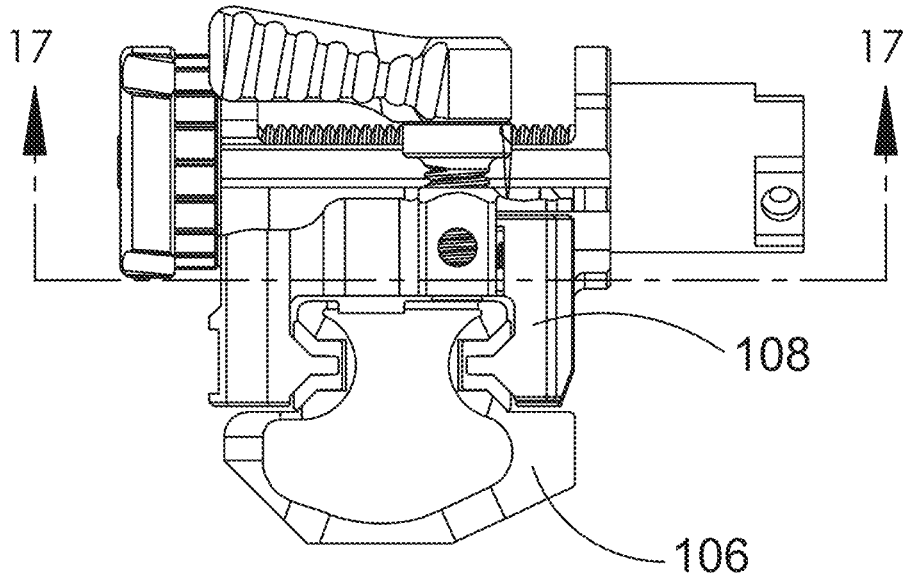
FIG. 16 is a partial section end view of the elevation tension assembly of FIGS. 13 and 15.

An elevation tension assembly is arranged on the top of the elevation rail guide as shown in FIG. 15. An elevation tension assembly including a lock lever 138 and locking screw 140 is operable when tightened to apply pressure on the elevation rail 106 to lift up the elevation carriage 108 and lock it in place. More particularly, the locking screw is threadably connected with a threaded opening in the elevation carriage. The elevation tension assembly screw 140 preferably has a nylon tip to keep from scarring the elevation rail. The lock lever is operable to rotate the screw which displaces the elevation carriage relative to the elevation rail. As the elevation carriage is lifted up from the elevation rail in a tightening direction, the gibs 130 (FIG. 14) lock the elevation carriage in place. The lock lever thus activates pressure movement from tight to loose in the direction of the target, eliminating left and right arrow impact error from the locked to unlocked condition should the archer not have time when firing a shot or forget to lock the elevation.

Figure 1:
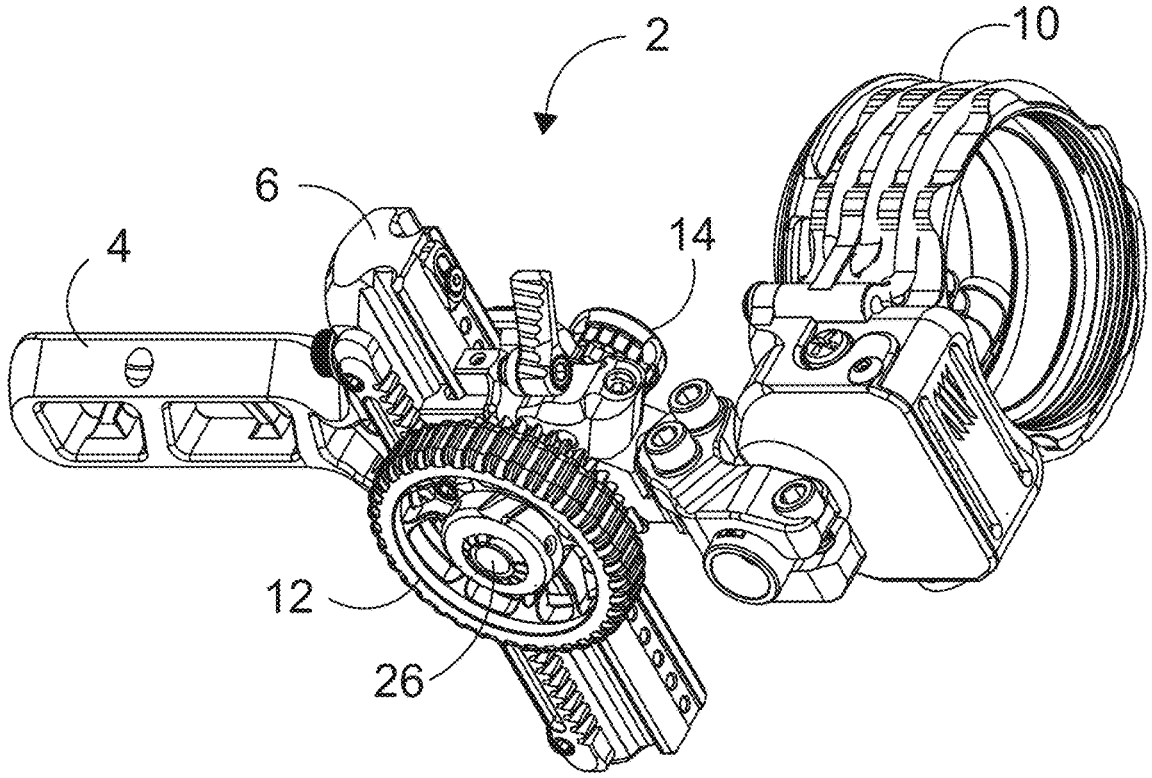
FIGS. 1-3 are a front perspective, top plan, and rear perspective views, respectively, of an archery sight mounting assembly according to the invention.
Figure 2:
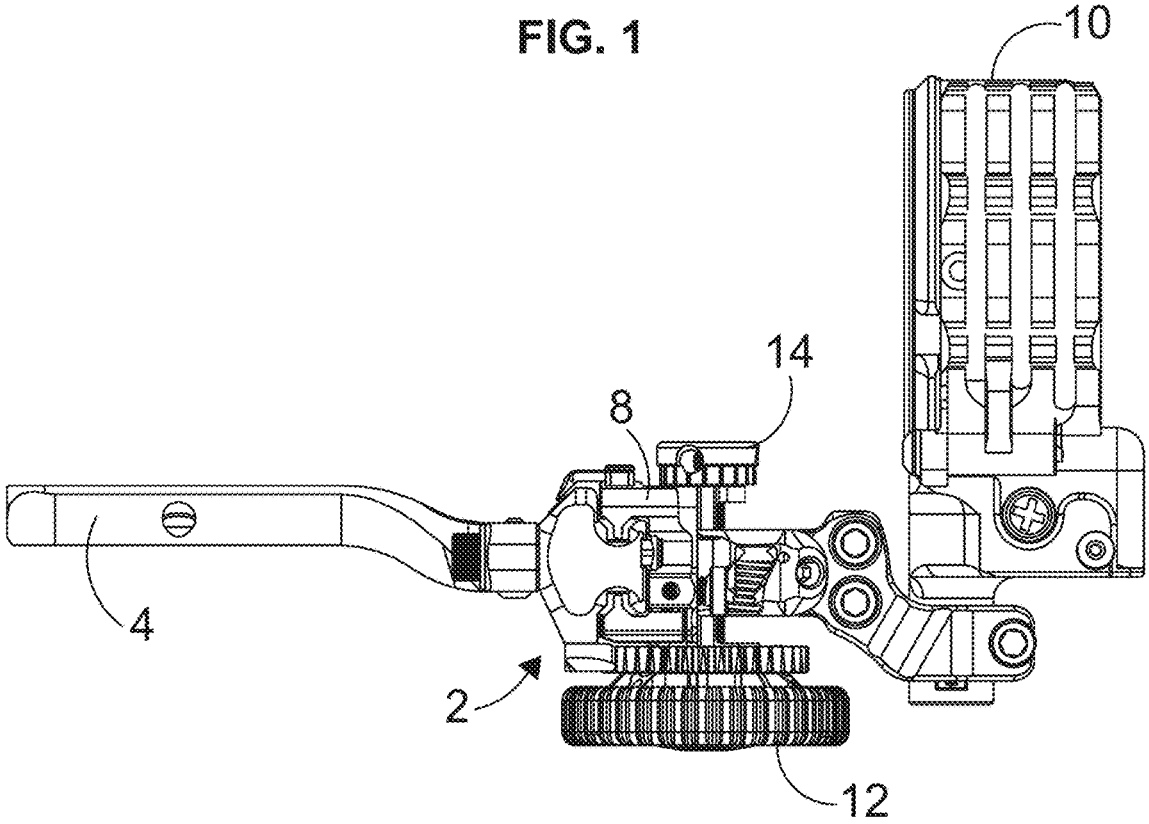
Figure 3:
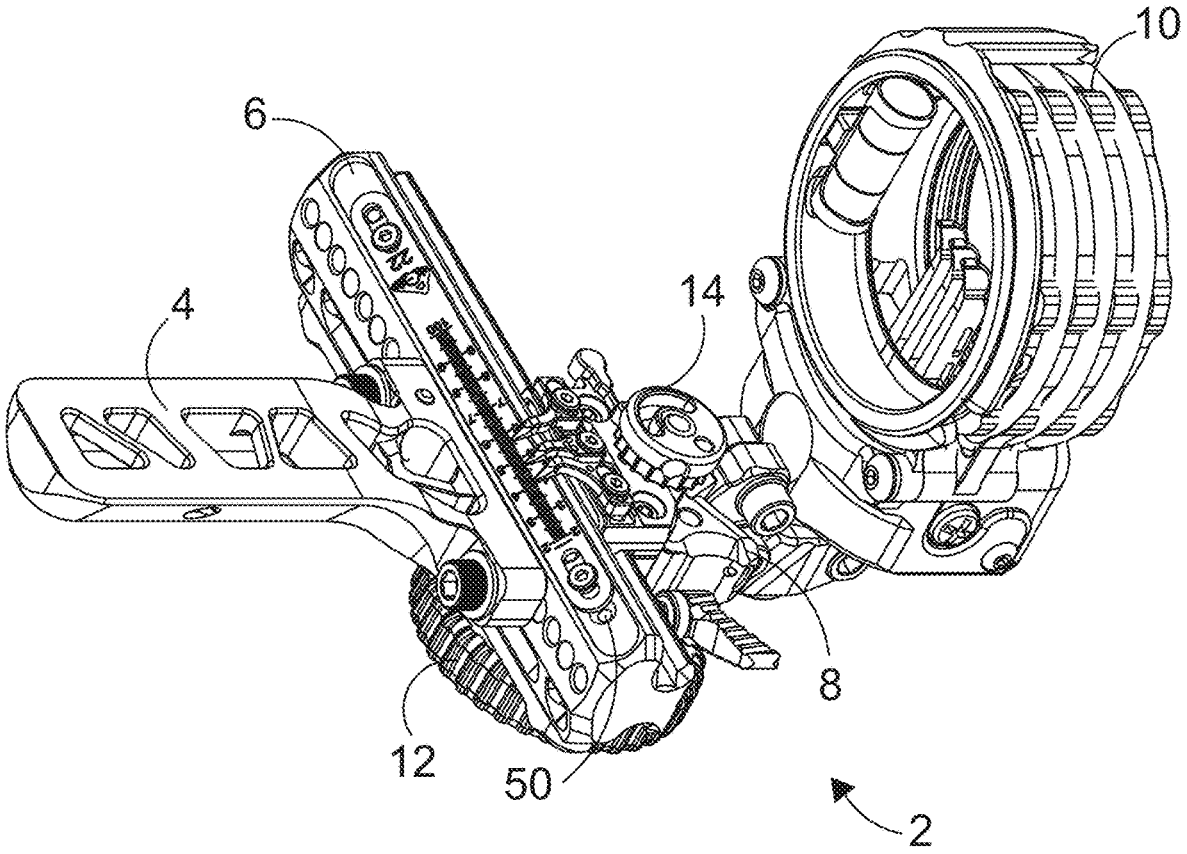
Figure 4:
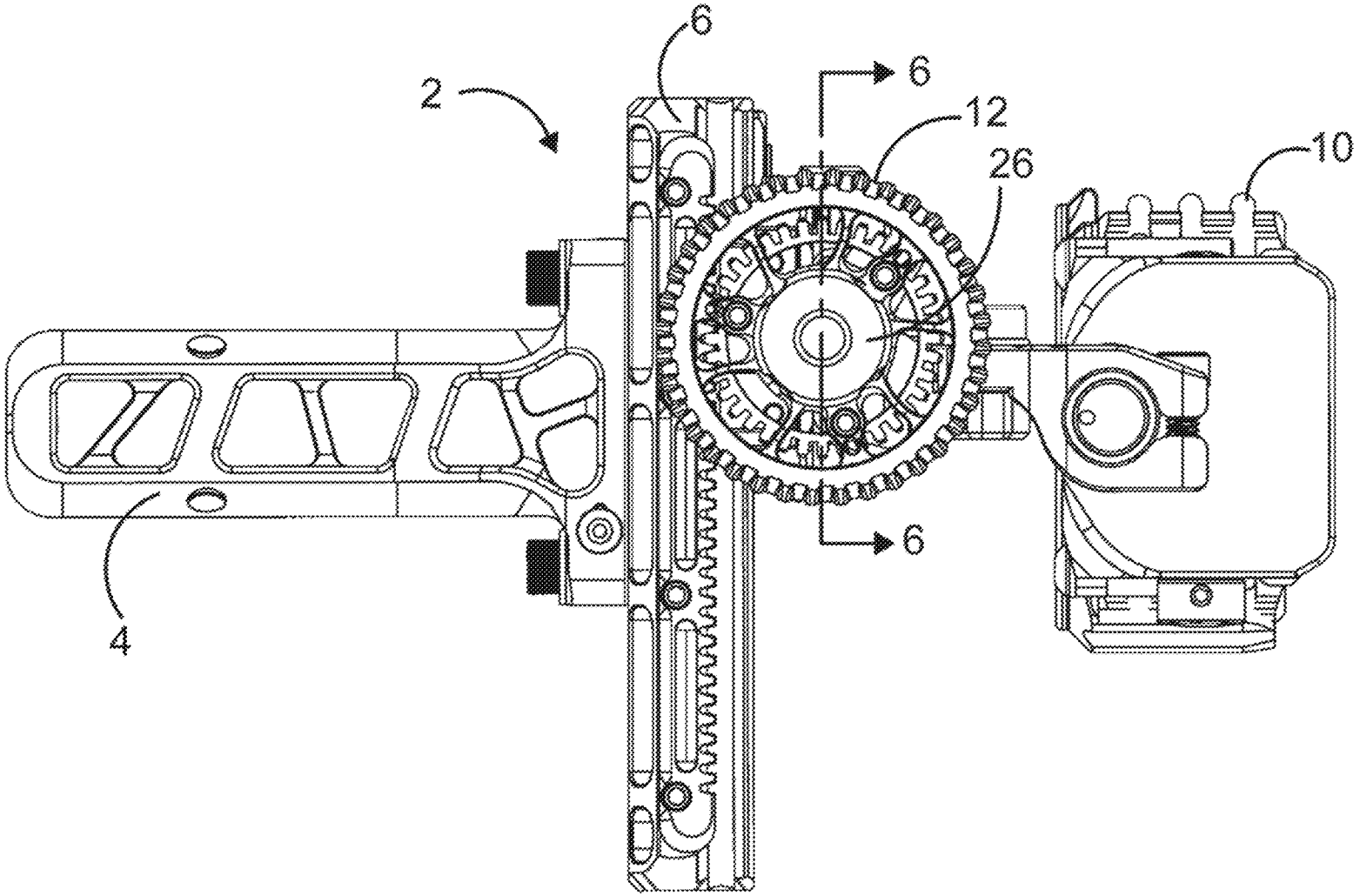
FIG. 4 is a front plan view of the mounting system of FIG. 1.
Figure 5:
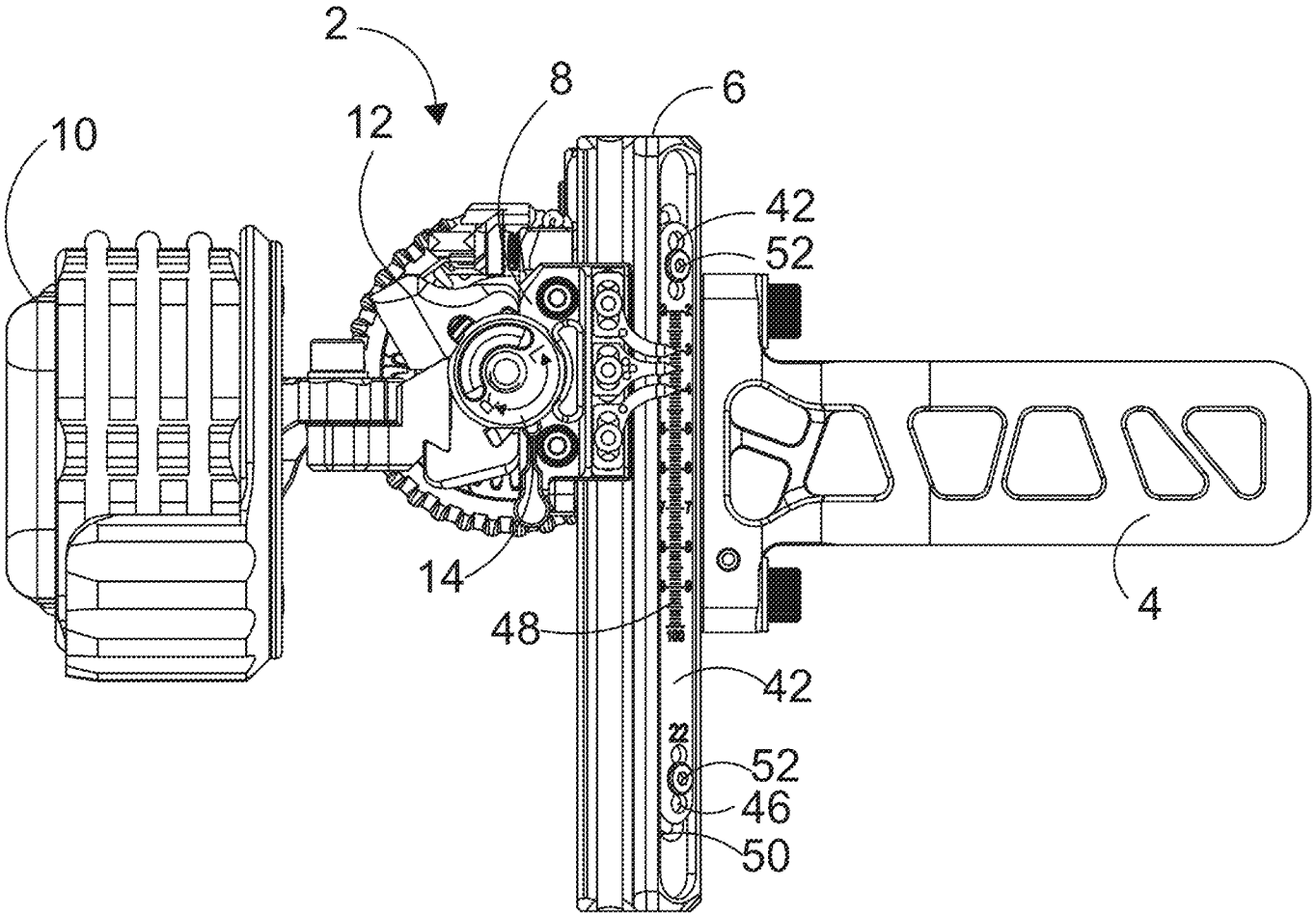
FIG. 5 is a rear plan view of the mounting system of FIG. 1.
Figure 19A:
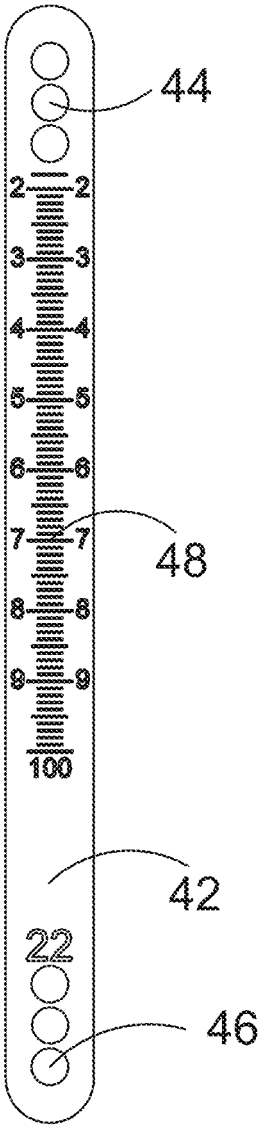
FIGS. 19*a*, 19*b* and 19*c* are front plan views of different embodiments, respectively, of a sight tape according to the invention.
Figure 19B:
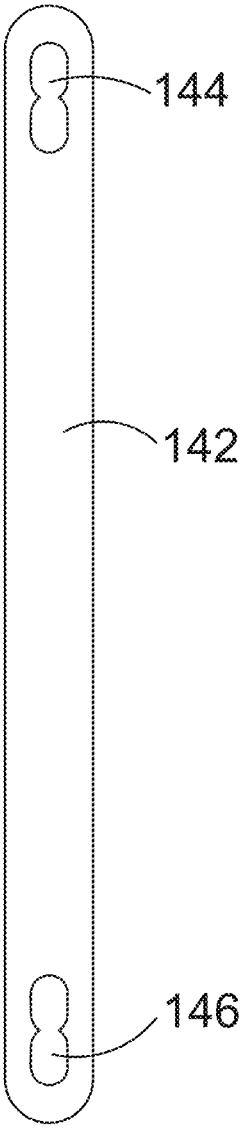
Figure 19C:
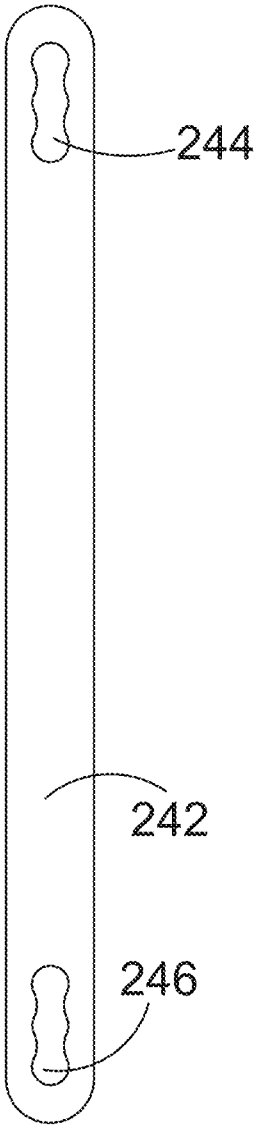

Various configurations for a sight tape according to the invention are shown in FIGS. 19*a-c*. In the embodiment of FIG. 19*a*, the sight tape 42 includes a plurality of equally spaced first openings 44 at one end of the tape and a plurality of equally spaced second openings 46 at the other end of the tape as well as indicia 48 therebetween with which an archer can accurately adjust the elevation of the sight. The sight tape is connected with the elevation rail 6 which contains a plurality of equally longitudinally spaced openings 50 along the length thereof as shown for example in FIGS. 3 and 5. By arranging the sight tape against the elevation rail and fastening the tape with rail with fasteners 52 in selected aligned holes in the tape and rail as shown in FIG. 5, the archer can select the optimal location for the sight tape.

In FIG. 19*b*, the sight tape 142 has an elongated scalloped opening 144 at one end and an elongated scalloped opening 146 at the other end. Each opening is defined by an indentation which effectively provides two different areas for receiving a fastener to connect the tape with the elevation rail. Because of the scalloped configuration of each opening, a limited amount of play is provided when positioning the tape on the elevation rail to provide additional adjustment of the tape on the rail beyond the positioning afforded by arranging the fasteners in selected openings in the rail. FIG. 19*b* shows a sight tape 242 similar to the sight tape 142 but with scalloped openings 244, 246 which are defined by two indentations to effectively provide three different areas for receiving a fastener to connect the tape with the elevation rail.

While in accordance with the provisions of the patent statute, the preferred forms and embodiments of the invention have been illustrated and described, it will be apparent to those of ordinary skill in the art that various changes may be made without deviating from the inventive concepts set forth above.

What is claimed is:

1. An archery sight mounting assembly, comprising (a) an elevation rail having a longitudinal axis;

(b) an elevation carriage slidably mounted on said elevation rail;

(c) an elevation adjustment knob having an outer diameter and an axis of rotation normal to the longitudinal axis of said elevation rail and operable to displace said elevation carriage along said elevation rail; and (d) a windage assembly connected with said elevation carriage for displacing a scope in a direction normal to the longitudinal axis of said elevation rail, said windage assembly including a windage adjustment knob having an axis of rotation parallel and fixed relative to the axis of rotation of said elevation adjustment knob and arranged within an extended outer diameter of and spaced non-concentrically from said elevation adjustment knob.

2. An archery sight mounting assembly as defined in claim 1, wherein said windage adjustment knob is arranged on a side of said elevation rail opposite said elevation adjustment knob.

3. An archery sight mounting assembly as defined in claim 2, wherein said windage adjustment knob axis is offset from said elevation adjustment knob axis.

4. An archery sight mounting assembly as defined in claim 1, wherein said elevation rail contains a plurality of longitudinally spaced openings and further comprising a sight tape having a longitudinal axis and containing at least one first opening at one end of said tape and at least one second opening at another end of said tape, respectively, whereby said sight tape can be connected with said elevation rail in a selected position by an archer with fasteners which pass through said first and second openings of said sight tape into selected corresponding openings in said elevation rail.

5. An archery sight mounting assembly as defined in claim 4, wherein said first and second openings in said sight tape have a scalloped configuration.

6. An archery sight mounting assembly as defined in claim 1, and further comprising a rail guide assembly arranged between said elevation rail and said elevation carriage, said rail guide assembly including a keyway extending inwardly from a side of said elevation carriage for accurate alignment of said elevation carriage relative to said elevation rail in a first direction and a V-shape configuration extending from said keyway for accurate alignment of said elevation carriage relative to said elevation rail in a second direction normal to said first direction.

7. An archery sight mounting assembly as defined in claim 6, wherein said rail guide assembly further comprises a gib arranged on a side of said elevation rail adjacent to said elevation carriage.

8. An archery sight mounting assembly as defined in claim 7, wherein said rail guide assembly further comprises a tension clamp arranged on said elevation rail to retain said gib in position between said elevation carriage and said elevation rail.

9. An archery sight mounting assembly as defined in claim 8, wherein said rail guide assembly further comprises a tension screw connected with said tension clamp to adjust an amount of tension applied to said gib.

10. An archery sight mounting assembly as defined in claim 9, and further comprising a spring arranged between said tension screw and said elevation carriage to bias said tension screw and supply consistent minimum tension to said tension clamp.

11. An archery sight mounting assembly as defined in claim 1, and further comprising a tension assembly arranged between said elevation carriage and said elevation rail, said tension assembly including a lock lever adjacent to said elevation carriage and operable to control a degree of tension applied between said elevation carriage and said elevation rail, thereby to lock and release said elevation carriage in a selected position relative to said elevation rail, said lock lever activating pressure movement from tight to loose in a direction of a target, thereby eliminating left and right arrow impact error from a locked condition to an unlocked condition.

12. An archery sight mounting assembly as defined in claim 11, wherein said tension assembly includes a pair of gibs arranged on opposite sides, respectively, of said elevation rail adjacent to said elevation carriage and a tension screw threadably connected with said elevation carriage and rotatable by said lock lever to draw said elevation carriage away from said elevation rail in a tightening direction, whereby said gibs lock said elevation carriage in the selected position.

13. An archery sight mounting assembly, comprising (a) an elevation rail having a longitudinal axis;

(b) an elevation carriage containing a U-shaped channel defined by a planar upper surface and opposed side surfaces arranged perpendicular to said upper surface for slidably mounting said elevation carriage on said elevation rail and configured to support an archery scope:

(c) a rail guide assembly arranged between said elevation rail and said elevation carriage, said rail guide assembly including a keyway arranged in said elevation carriage channel and extending inwardly from at least one side surface of said elevation carriage for accurate alignment of said elevation carriage relative to said elevation rail in a first direction and a V-shape configuration extending from said keyway toward said side surface for accurate alignment of said elevation carriage relative to said elevation rail in a second direction normal to said first direction; and (d) a gib having a V-shape configuration corresponding to the V-shape configuration of said keyway, said gib being arranged between said keyway of said elevation carriage and a side of said elevation rail.

14. An archery sight mounting assembly as defined in claim 13, wherein said rail guide assembly further comprises a tension clamp arranged on said elevation rail to retain said gib in position between said elevation carriage and said elevation rail.

15. An archery sight mounting assembly as defined in claim 14, wherein said rail guide assembly further comprises a tension screw connected with said tension clamp to adjust an amount of tension applied to said gib.

16. An archery sight mounting assembly as defined in claim 15, and further comprising a spring arranged between said tension screw and said elevation carriage to bias said tension screw and supply consistent minimum tension to said tension clamp.

* * * * *